US010202857B2

(12) United States Patent
Simonds et al.

(10) Patent No.: US 10,202,857 B2
(45) Date of Patent: Feb. 12, 2019

(54) VANE STAGES

(71) Applicant: UNITED TECHNOLOGIES CORPORATION, Farmington, CT (US)

(72) Inventors: Mark E. Simonds, Cape Neddick, ME (US); Steven J. Feigleson, Falmouth, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 680 days.

(21) Appl. No.: 14/616,274

(22) Filed: Feb. 6, 2015

(65) Prior Publication Data

US 2016/0230574 A1 Aug. 11, 2016

(51) Int. Cl.
*F01D 9/04* (2006.01)
*F01D 11/00* (2006.01)
(Continued)

(52) U.S. Cl.
CPC ..... *F01D 9/041* (2013.01); *F01D 11/001* (2013.01); *F01D 11/003* (2013.01);
(Continued)

(58) Field of Classification Search
USPC ..... 415/210.1
See application file for complete search history.

(56) References Cited

U.S. PATENT DOCUMENTS 2,738,949 A 3/1956 Henry
3,275,294 A * 9/1966 Allen ..... F01D 5/081 415/115
(Continued)

FOREIGN PATENT DOCUMENTS

EP 0945597 A1 9/1999
FR 2979662 A1 3/2013
(Continued)

OTHER PUBLICATIONS

Sprovieri, John. "Best Practices for Press-Fit Assembly." Assembly Magazine, Feb. 8, 2005, www.assemblymag.com/articles/84160-running-interference. Accessed Sep. 17, 2017.*
(Continued)

*Primary Examiner* — William McCalister
*Assistant Examiner* — Richard K Durden
(74) *Attorney, Agent, or Firm* — Cantor Colburn LLP

(57) ABSTRACT

A vane stage includes an arcuate platform defining a axial centerline axis having a pair of flanges that extend radially inward from the platform. The flanges are axially spaced from one another and from respective forward and aft ends of the platform. The vane stage includes a vane extending radially outward from the platform and a seal carrier mounted to the flanges of the platform. A method for constructing a vane stage includes sliding a seal carrier between flanges of an arcuate platform. Each flange includes at least a pair of through holes and interfaces with a respective axial side of the seal carrier. The method includes drilling through holes in each axial side of the seal carrier by using the through holes of each flange as guides.

8 Claims, 2 Drawing Sheets

(51) Int. Cl.
*F01D 25/00* (2006.01)
*F01D 25/24* (2006.01)

(52) U.S. Cl.
CPC ..... *F01D 25/005* (2013.01); *F01D 25/246* (2013.01); *F01D 25/243* (2013.01); *F05D 2220/32* (2013.01); *F05D 2230/10* (2013.01); *F05D 2230/60* (2013.01); *F05D 2240/12* (2013.01); *F05D 2240/55* (2013.01); *F05D 2240/80* (2013.01); *F05D 2300/133* (2013.01); *F05D 2300/603* (2013.01)

(56) References Cited

U.S. PATENT DOCUMENTS 3,945,758 A 3/1976 Lee
4,113,406 A 9/1978 Lee et al.
4,869,640 A 9/1989 Schwarz et al.
4,897,021 A * 1/1990 Chaplin ..... F01D 5/22 267/160
5,482,433 A * 1/1996 Norris ..... F01D 5/22 415/173.7
6,425,738 B1 * 7/2002 Shaw ..... F01D 9/041 415/208.1
8,297,934 B2 * 10/2012 Lutz ..... F01D 5/14 415/200
8,454,303 B2 * 6/2013 Garcia-Crespo ..... F01D 9/042 415/137
8,740,556 B2 * 6/2014 Papin ..... F01D 9/041 415/189
9,453,425 B2 * 9/2016 Brummitt-Brown ... F01D 9/045
2007/0065286 A1 * 3/2007 Bolgar ..... F01D 11/001 416/193 A
2009/0185896 A1 7/2009 Kizuka et al.
2010/0068034 A1 * 3/2010 Schiavo ..... F01D 5/189 415/115
2011/0150640 A1 6/2011 Tiemann et al.
2013/0259673 A1 * 10/2013 Waki ..... F01D 25/00 415/208.1
2014/0227088 A1 8/2014 Beaujard et al.
2015/0086331 A1 * 3/2015 Hess ..... F01D 9/04 415/111
2016/0115800 A1 * 4/2016 Lyders ..... F01D 9/02 415/208.1
2016/0305265 A1 * 10/2016 Stapleton ..... F04D 29/321
2017/0306776 A1 * 10/2017 Simonds ..... F01D 25/243
2017/0335701 A1 * 11/2017 Biolsi ..... F01D 9/042

FOREIGN PATENT DOCUMENTS

GB 853997 A 11/1960
GB 2110768 A 6/1983
WO 2014004017 A1 1/2014

OTHER PUBLICATIONS

European Search Report and Communication; Application No. 16154554.6-1610/3054104; Dated Nov. 18, 2016; 12 pages.
English Machine Translation for EP0945597.
English Abstract Translation for EP0945597.
English Abstract Translation for FR 979662.

* cited by examiner

VANE STAGES

STATEMENT REGARDING FEDERALLY SPONSORED RESEARCH OR DEVELOPMENT

This invention was made with government support under contract number N00019-02-C-3003 awarded by the United States Department of Defense. The government has certain rights in the invention.

BACKGROUND OF THE INVENTION

1. Field of the Invention

The present disclosure relates to turbomachine components, such as stator vane stages and vane support systems in gas turbine engines.

2. Description of Related Art

Traditionally, gas turbine engines can include multiple stages of vanes to condition and guide airflow through the fan, compressor and/or turbine sections. The vane stages are configured to optimize airflow characteristics for various operating conditions. The vane stages are subject to high temperatures, aerodynamic loading and pressures that can affect their durability.

It is expected that this will be exacerbated due to the ongoing trend of designing gas turbine engines to operate at even higher temperatures and pressures. As such, there is still a need in the art for improved vane stages that can operate at high temperatures while still providing the desired stiffness and ease of manufacture.

SUMMARY OF THE DISCLOSED EMBODIMENTS

A vane stage includes an arcuate platform defining a axial centerline axis having a pair of flanges that extend radially inward from the platform. The flanges are axially spaced from one another and from respective forward and aft ends of the platform. The vane stage includes a vane extending radially outward from the platform and a seal carrier mounted to the flanges of the platform.

The axial distance between the flanges can range from 63% to 77% of the chord length of the vane. The axial distance between the flanges can range from 56% to 84% of the chord length of the vane. One of the flanges proximate to the forward end of the platform can be axially spaced apart from the forward end of the platform the same distance as the other flange proximate to the aft end of the platform is axially spaced apart from the aft end of the platform. The seal carrier can be mounted axially between the flanges. The vane and platform can be made from titanium, and/or the seal carrier can be made from composite. The vane and platform can be co-fabricated.

The seal carrier can be one of a plurality of arcuate seal carriers. Each arcuate seal carrier can include a neck portion at one end that extends in a circumferential direction to nest within an end of a neighboring arcuate seal carrier. Axial outwardly facing sides of each neck portion can be in an interference fit with corresponding axial inwardly facing sides of the neighboring seal carrier in which each neck portion rests.

In accordance with other embodiments, a vane stage includes a washer mounted to the seal carrier. The washer is opposite of one of the flanges of the platform across the axial thickness of a side of the seal carrier. A portion of the seal carrier between the washer and flange can include at least two through holes in an axial direction for receiving respective fasteners. The washer can include a pair of through holes that correspond to respective pairs of holes in the platform flanges and the seal carrier. A cross-sectional area of the washer surface that interfaces with the seal carrier can be at least eight times greater in area than the total cross-sectional area of through holes in the portion of the seal carrier that the washer surface interfaces with. The washer can have a race-track shape.

In accordance with another embodiment, a method for constructing a vane stage includes sliding a seal carrier between flanges of an arcuate platform. Each flange includes at least a pair of through holes and interfaces with a respective axial side of the seal carrier. The method includes drilling through holes in each axial side of the seal carrier by using the through holes of each flange as guides. The method can include securing the axial sides of the seal carrier to respective flanges with fasteners inserted through the through holes of the flanges and the seal carrier. Securing the axial sides of the seal carrier to respective flanges can include placing a washer opposite each flange across the seal carrier.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
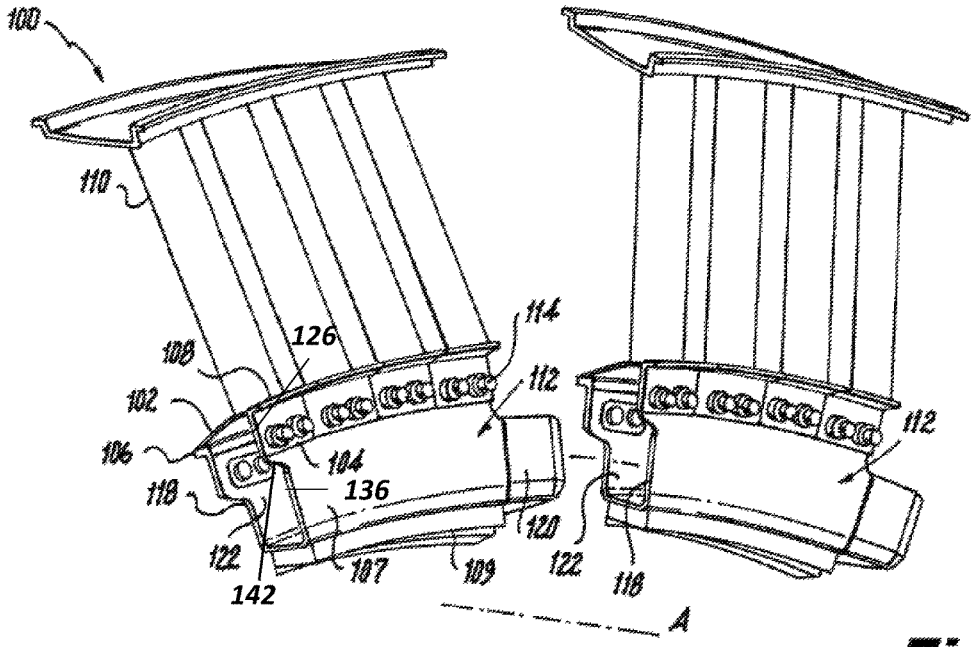
FIG. 1 is a perspective exploded view of an exemplary embodiment of a portion of a vane stage constructed in accordance with the present disclosure, showing sides of a seal carrier mounted between a washer and a flange of a vane platform.

Reference will now be made to the drawings wherein like reference numerals identify similar structural features or aspects of the subject disclosure. For purposes of explanation and illustration, and not limitation, a perspective view of an exemplary embodiment of a portion of a vane stage for a gas turbine engine constructed in accordance with the disclosure is shown in FIG. 1 and is designated generally by reference character 100. Other embodiments of vane stages constructed in accordance with the disclosure, or aspects thereof, are provided in FIGS. 2-4, as will be described. A vane stage as shown and described herein can be used in a variety of gas turbine engines, for example low bypass ratio gas turbine engines or high bypass ratio gas turbine engines, such as in the second vane stage of a fan section of a low bypass ratio gas turbine engine. Embodiments of vanes stages shown and described herein provide improved operation at high temperatures while still having the desired stiffness, and ease of manufacture.

Figure 3:
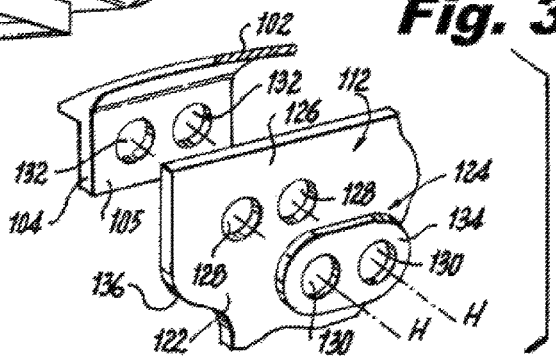
FIG. 3 is a perspective exploded view of a portion of the vane stage of FIG. 1, showing the through holes of the washer, seal carrier and flange.

As shown in FIG. 1, vane stage 100 includes a plurality of arcuate platforms 102 circumferentially arranged to form an annulus. Each arcuate platform 102 defines a axial centerline axis A. A pair of flanges 104 extend radially inward from each platform 102. Flanges 104 are axially spaced from one another and from respective forward and aft ends 106 and 108, respectively, of platform 102. Vane stage 100 includes vanes 110 extending radially outward from respective platforms 102 and a seal carrier 112 mounted with fasteners 114 to flanges 104 of platforms 102. Seal carrier 112 is mounted axially between flanges 104 so that inner surfaces 105, one of which is shown in FIG. 3, of flanges 104, interface with outer surfaces 107 of seal carrier 112. A seal 109 extends radially inward from carrier 112 for interfacing with a rotor disk, not shown. It is contemplated that a variety of suitable fasteners 114 can be used, for example, HI-LOK® pin rivets and shear collars available from Hi-Shear Corporation of Torrance, Calif.

With continued reference to FIG. 1, vane stage 100 allows for vanes 110 and platforms 102 to be separately formed and then joined together with seal carrier 112. This permits vane 110 and platform 102 to be made from titanium, while seal carrier 112 can be made from a composite material, contrary to traditional configurations where the vanes, platforms and seal carrier are co-fabricated from composite material. High temperatures and pressures tend to be challenging for composite materials, especially for use in components under high aerodynamic loading, such as vanes 110. Vane stage 100 effectively joins titanium vanes and platforms, for example, vanes 110 and platforms 102, to a composite seal carrier, for example, seal carrier 112, providing the durability for high loads and high temperatures but allows use of lightweight composite for the relatively lower stressed seal carrier of the vane stage. Vane 110 and platform 102 are shown as being co-fabricated, however those skilled in the art will readily appreciate that vane 110 and platform 102 can be formed separately from titanium or other suitable materials.

Vane stage 100 allows vanes 110 and platforms 102 to be joined to seal carrier 112 without the need for adhesives and without the need for bushings adhered to the composite. Adhesives are generally are not capable of operating at high operating temperatures and bushings tend to add weight to the vane stage assembly and tend to increase manufacturing complexity. Additionally, vane stage 100 overcomes traditional problems with using fasteners such as limitations to hole alignment and drilling, and slippage under low flange stack compression and access to fasteners inside the seal carrier.

Figure 2:
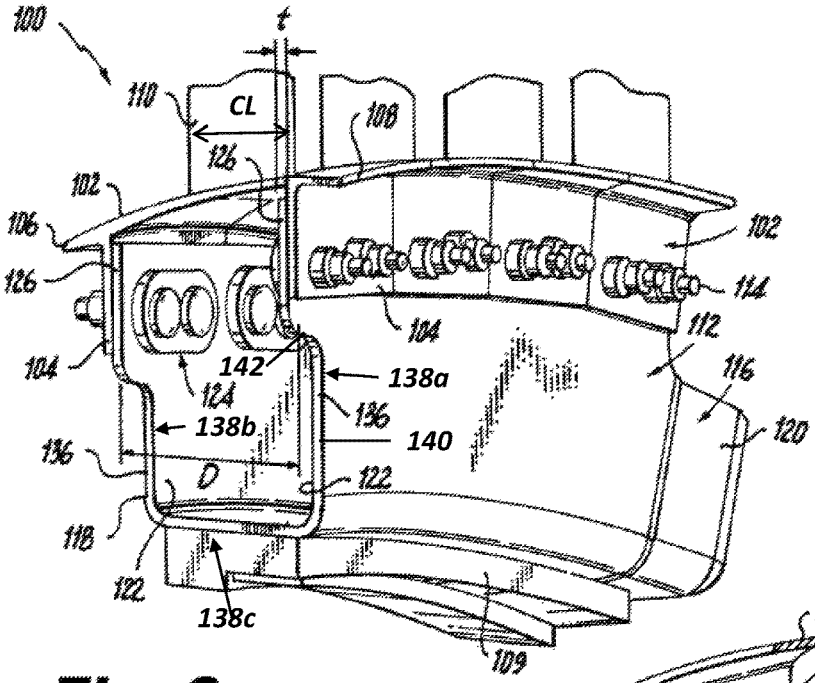
FIG. 2 is a perspective view of a portion of the vane stage of FIG. 1, showing the fasteners securing the seal carrier, flanges and washers together.

As shown in FIG. 2, an axial distance D between flanges 104 can range from 56% to 84% of the chord length, CL, of one of vanes 110. Preferably, axial distance D between flanges 104 can range from 63% to 77% of the chord length, CL or more particularly, axial distance D can be 70% of the chord length, CL, of one of vanes 110. One of flanges 104 on each of the platforms 102 proximate to forward end 106 of the platform is axially spaced apart from forward end 106 of the platform the same distance as the other flange 104 proximate to aft end 108 of platform 102 is axially spaced apart from aft end 108 of platform 102. The spacing between pairs of flanges 104 relative to the chord length of respective vane 110 provides stiffness for vibration tuning.

With reference now to FIGS. 2 and 3, vane stage 100 includes washers 124 mounted to the seal carrier. Each washer 124 is opposite of one of flanges 104 of platform 102 across the axial thickness t of one of sides 136 of seal carrier 112. A portion 126 of seal carrier 112 between each washer 124 and flange 104 includes two through holes 128 in an axial direction for receiving respective fasteners 114. Each washer 124 includes a pair of through holes 130 that correspond to respective pair of holes 132 in flanges 104 and to through holes 128 of seal carrier 112. Those skilled in the art will readily appreciate that through holes 128 are positioned in seal carrier 112 such that only a few fasteners are required to carry the prying load from differential pressure across seal carrier 112, and the vane over-turning moments caused by aerodynamic gas loads acting on vanes 110 and platforms 102.

With continued reference to FIG. 3, a cross-sectional area of each washer surface that interfaces with seal carrier 112, for example, the surface opposite that of washer surface 134, is at least eight times greater in area than the total cross-sectional area of through holes 128 that the respective washer surface interfaces with, for example, the cross-sectional area of two holes 128. The cross-sectional area of each through hole 128 is taken perpendicular to respective hole axes H. Each washer 124 assists in spreading out fastener 114 pre-load over respective axial inwardly facing sides 122 of carrier 112. Those skilled in the art will readily appreciate that while washers 124 are shown as having a race-track shape, washers 124 can take any suitable shape, such as, oval, rectangular, egg, round, and/or the like. It is also contemplated that washers 124 can be divided into separate washer portions that make up a similar shape as those described above.

As shown in FIGS. 1 and 2, seal carrier 112 is one of a plurality of arcuate seal carriers. Each arcuate seal carrier 112 includes a neck portion 116 at one end that extends in a circumferential direction to nest within an end 118 of a neighboring arcuate seal carrier 112, ultimately forming a seal carrier ring. Axial outwardly facing sides 120 of neck portion 116 are interference fit with corresponding axial inwardly facing sides 122 of the neighboring seal carrier 112 in which each neck portion 116 rests. The interference fit between respective axial outwardly facing sides 120 of neck portion 116 and axial inwardly facing sides 122 of neighboring carrier 112 provides durability and vibration control for the seal carrier ring. Each seal carrier 112 includes a first leg **138*a* defining a first axial inwardly facing side 122 and a first axial outwardly facing side 120, a second leg 138*b* disposed opposite the first leg 138*a* defining a second axial inwardly facing side 122 and a second axial outwardly facing side 120, and a base 138*c* from which the first leg 138*a* and the second leg 138*b* radially extend. The first leg 138*a*, the second leg 138*b*, and the base 138*c* circumferentially extend between the neck portion 116 at one end and the end 118. At the end 118 of the seal carrier 112 opposite the neck portion 116, each of the first leg 138*a* and the second leg 138*b* include the portion 126 that is disposed parallel to the flange 104, a second portion 140 disposed parallel to and not coplanar with the portion 126, and a third portion 142 extending between and disposed in a non-parallel relationship with the portion 126 and the second portion 140**.

Figure 4:
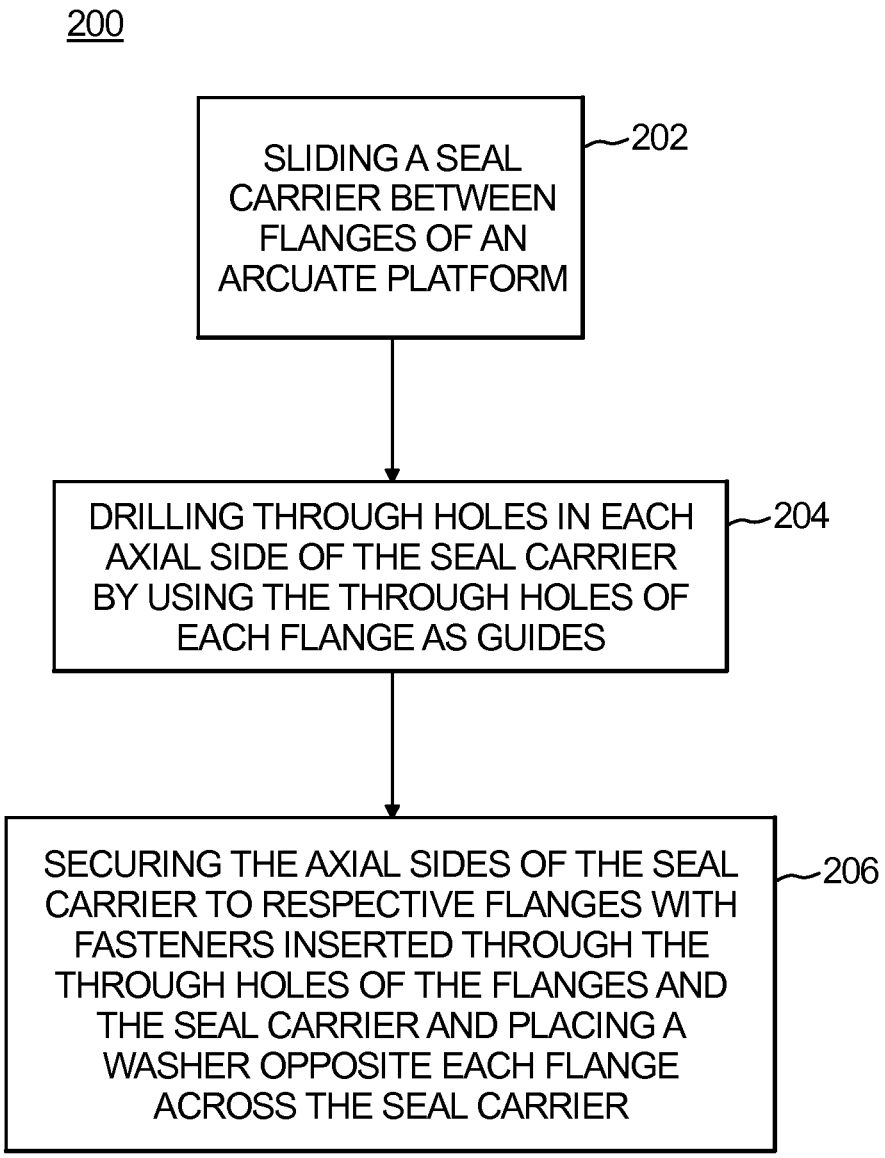
FIG. 4 is a method for constructing a vane stage, schematically showing the method.

With reference now to FIG. 4, method 200 for constructing a vane stage, for example, vane stage 100, includes sliding a seal carrier, for example, seal carrier 112, between flanges, for example, flanges 104, of an arcuate platform, for example, arcuate platform 102, as shown in box 202. Each flange includes at least a pair of through holes, for example, through holes 132, and interfaces with a respective axial side, for example, side 136, of the seal carrier. Method 200 includes drilling through holes, for example, through holes 128, in each axial side of the seal carrier by using the through holes, for example, through holes 132, of each flange as guides, for example, transfer drilling, as shown in box 204. By assembling the vane stage with the flanges placed on outer surfaces, for example, outer surfaces 107, of the seal carrier and using the through holes of each flange as guides, the need for bushings and adhesive is eliminated, reducing weight and manufacturing complexity.

Method 200 includes securing the axial sides of the seal carrier to respective flanges with fasteners, for example, fasteners 114, inserted through the through holes of the flanges and the seal carrier, as shown in box 206. Securing the axial sides of the seal carrier to respective flanges includes placing a washer, for example, washer 124, opposite each flange across the seal carrier, also shown in box 206. Each washer includes at least two through holes, for example, through holes 130, for receiving the fasteners. The through holes of each washer correspond to the pair of through holes on each flange.

The methods and systems of the present disclosure, as described above and shown in the drawings, provide for gas turbine engines and vane stages with superior properties including reduced weight and increased stiffness. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A vane stage comprising:

an arcuate platform defining an axial centerline axis, the arcuate platform having a pair of flanges that extend radially inward from the platform, wherein the flanges are axially spaced apart from one another and from respective forward and aft ends of the platform;

a vane extending radially outward from the platform; and a seal carrier includes a first leg, a second leg, and a base from which the first leg and the second leg radially extend, each of the first leg and the second leg having axial inwardly facing sides that are disposed parallel to and spaced apart from the flanges and axial outwardly facing sides that engage inner faces of the flanges, the seal carrier being mounted to the flanges of the platform, the seal carrier is one of a plurality of arcuate seal carriers, each arcuate seal carrier includes a neck portion at one end that extends in a circumferential direction to nest within an end of a neighboring arcuate seal carrier and each of the first leg and the second leg of the seal carrier at an end of the seal carrier opposite the neck portion includes a portion disposed parallel to a flange of the pair of flanges, a second portion disposed parallel to the portion, and a third portion extending between and disposed in a non-parallel relationship with the portion and the second portion.

2. A vane stage as recited in claim 1, wherein an axial distance between the flanges ranges from 63% to 77% of a chord length of the vane.

3. A vane stage as recited in claim 1, wherein an axial distance between the flanges ranges from 56% to 84% of a chord length of the vane.

4. A vane stage as recited in claim 1, wherein one of the flanges proximate to the forward end of the platform is axially spaced apart from the forward end of the platform the same distance as the other flange proximate to the aft end of the platform is axially spaced apart from the aft end of the platform.

5. A vane stage as recited in claim 1, wherein the vane and platform are titanium.

6. A vane stage as recited in claim 1, wherein the seal carrier is composite.

7. A vane stage as recited in claim 1, wherein the vane and platform are co-fabricated.

8. A vane stage as recited in claim 1, wherein axial outwardly facing sides of each neck portion are in an interference fit with corresponding axial inwardly facing sides of the neighboring seal carrier in which each neck portion rests.

* * * * *